US005140888A

United States Patent [19]

Ito

[11] Patent Number: 5,140,888

[45] Date of Patent: Aug. 25, 1992

[54] ELECTRONIC WIND INSTRUMENT HAVING BLOWING FEELING ADDER

[75] Inventor: Yoshihisa Ito, Hamamatsu, Japan

[73] Assignee: Yamaha Corporation, Hamamatsu, Japan

[21] Appl. No.: 686,042

[22] Filed: Apr. 16, 1991

[30] Foreign Application Priority Data

May 21, 1990 [JP] Japan ..... 2-129180

[51] Int. Cl.[5] ..... G10H 1/02; G10H 3/14

[52] U.S. Cl. ..... 84/723; 84/737; 84/DIG. 21

[58] Field of Search ..... 84/723-725, 84/729, 730, 732-742, 330, 377-401, DIG. 21

[56] References Cited

U.S. PATENT DOCUMENTS 4,252,045 2/1981 Nagura ..... 84/DIG. 21

4,704,938 11/1987 Zacharias ..... 84/377

FOREIGN PATENT DOCUMENTS 2-76798 6/1990 Japan .

*Primary Examiner*—Stanley J. Witkowski

*Attorney, Agent, or Firm*—Spensley Horn Jubas & Lubitz

[57] ABSTRACT

An electronic wind instrument has a blowing feeling adder. The adder comprises an air chamber having an entrance and an exit, an entrance pipe for introducing breath the entrance pipe being coupled to the entrance of the air chamber, an exit pipe for discharging the breath the exit pipe being connected to the exit of the air chamber, and a valve interposed between entrance and exit portions of the air chamber and having elasticity. The valve is deformed according to a breath pressure at the entrance portion to change an opening area of the entrance. Whereby the electronic wind instrument can simulate blowing feeling of a natural wind instrument.

6 Claims, 6 Drawing Sheets

ELECTRONIC WIND INSTRUMENT HAVING BLOWING FEELING ADDER

BACKGROUND OF THE INVENTION

1. Field of the Invention

The present invention relates to an electronic wind instrument and, more particularly, to an electronic wind instrument which has a blowing feeling adder for simulating blowing feeling of an acoustic wind instrument.

2. Description of the Prior Art

An electronic wind instrument controls various musical tone parameters such as tone volumes, tone colors, pitches, vibrate depth, and the like on the basis of a playing breath pressure, key switch operations and embouchure, and can electrically generate and produce electronic tones approximate to those of an acoustic wind instrument. Blowing feeling of such an electronic wind instrument mainly depends on the relationship between a breath pressure and a corresponding flow rate of air (breath) flowing through the instrument.

FIG. 10 shows flow rate characteristics as a function of a breath pressure of a conventional wind instrument and an acoustic wind instrument.

In the conventional electronic wind instrument, a flow rate is almost linearly disclosed as a breath pressure is increased, as indicated by an alternate long and two short dashed curve a.

On the other hand, in flow rate characteristics of the acoustic wind instrument, when the breath pressure is low at the beginning of blowing, the flow rate is immediately increased by a large change amount, as indicated by an alternate long and two short dashed curve b. Thereafter, the flow rate is decreased, and tone generation is started at a point A. If the breath pressure is increased thereafter, the flow rate is slowly increased, as indicated by a solid curve c. If the breath pressure is decreased, the flow rate returns along the solid curve c, tone generation continues up to a point B beyond the point A, and the breath air is relieved due to hysteresis characteristics, as indicated by an alternate long and two short dashed curve d.

As described above, flow rate characteristics of the conventional electronic wind instrument almost linearly change with respect to a breath pressure, and are considerably different from those of the acoustic wind instrument wherein a change in flow rate is large at a low breath pressure, and a change in flow rate becomes small at a predetermined breath pressure or higher. For this reason, the electronic wind instrument and the acoustic instrument have considerably different playing feelings. When a player accustomed to acoustic wind instruments plays an electronic wind instrument, he or she feels with malaise due to lack of breath air relief feeling at a low breath pressure, and due to excess breath air relief feeling when he strengthens a breath pressure.

SUMMARY OF THE INVENTION

The present invention has been made in consideration of the conventional drawbacks, and has as its object to provide an electronic wind instrument which can approximate flow rate characteristics to those of an acoustic wind instrument, thus eliminating malaise upon performance.

In order to achieve the above object, according to the present invention, a blowing feeling adder of an electronic wind instrument comprises an air chamber having an entrance and an exit, an entrance pipe, coupled to the entrance of the air chamber, for introducing breath, an exit pipe, connected to the exit of the air chamber, for discharging the breath, and valve means interposed between entrance and exit portions of the air chamber, and having elasticity, wherein the valve means is deformed according to a breath pressure at the entrance portion to change an opening area of the entrance.

When the breath pressure at the entrance portion of the air chamber exceeds a predetermined value, the valve means is pressed against the exit portion side, and decreases an opening area of the exit.

The adder further comprises spacer means for forming an air communication path between the valve means and the exit portion in at least a portion around the exit portion when the valve means is pressed toward the exit portion side.

When the breath pressure is low, the valve means is biased toward the entrance side of the air chamber due to its elasticity, and is deformed as the breath pressure is increased, thus increasing an opening area. Therefore, the flow rate is largely increased as the breath pressure is increased.

When the breath pressure is increased to some extent, the opening area can no longer be increased, and an increase in flow rate is stopped. When the breath pressure is further increased, the valve means is further deformed, and reaches the exit portion side, thus decreasing the opening area of the exit portion side. Therefore, the flow rate is decreased.

When the valve means is pressed toward the exit portion side, it does not completely close the exit portion, and a predetermined gap can be formed by a spacer such as a projection, thus forming an air flow path.

DETAILED DESCRIPTION OF THE PREFERRED EMBODIMENT

Figure 1:
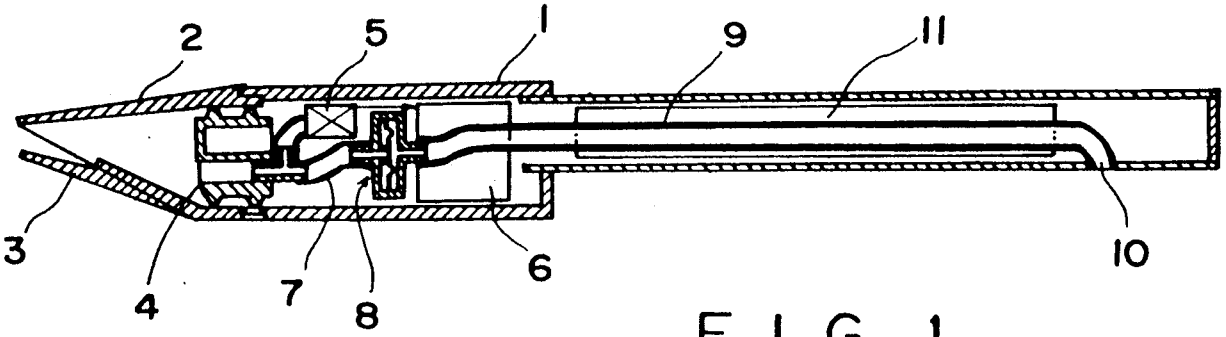
FIG. 1 is a sectional view of an electronic wind instrument having a blowing feeling adder according to the present invention.

FIG. 1 is a sectional view showing an overall structure of an electronic wind instrument according to the present invention.

A mouthpiece 2 and a reed 3 are attached to a blowing section of an instrument main body 1. A seal rubber 4 is arranged in a joint portion between the main body 1 and the mouthpiece 2. Air (breath) passing through the seal rubber 4 is introduced into a blowing feeling adder 8 according to the present invention via a breath inlet tube 7. The air passing through the seal rubber 4 is partially introduced to a pressure sensor 5. A breath pressure signal detected by the pressure sensor 5 is supplied to a control circuit 6. The control circuit 6 receives the breath pressure signal, a key code signal from a key switch section 11, and the like, and controls intervals, tone colors or various musical tone control parameters such as pitches, vibrato levels, embouchure, and the like, thus generating electronic tones.

On the other hand, the air passing through the blowing feeling adder 8 is discharged from a discharging port 10 via a drain tube 9.

The structure of the blowing feeling adder 8 will be described below with reference to FIGS. 2 to 5.

Figure 2:
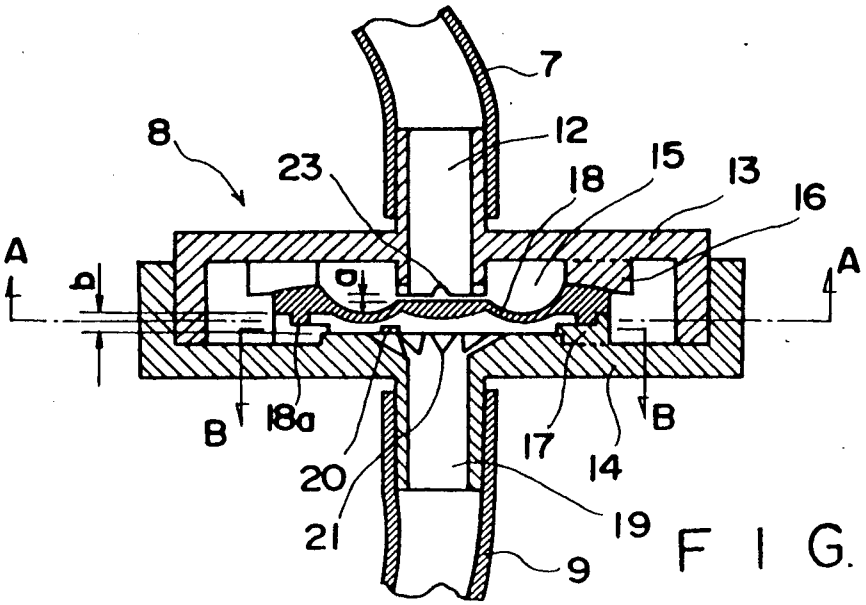
FIG. 2 is a sectional view of the blowing feeling adder.
Figure 3:
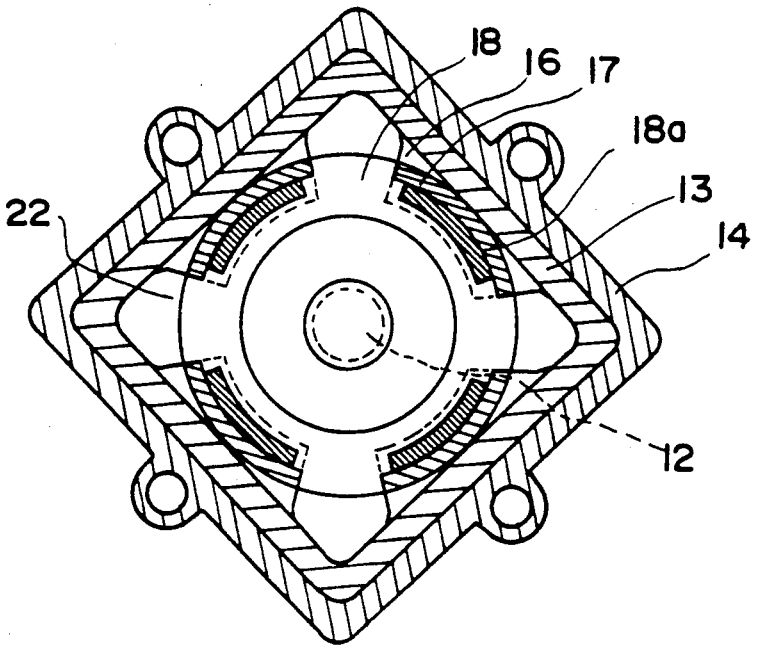
FIG. 3 is a sectional view taken along a line A—A in FIG. 2.
Figure 4:
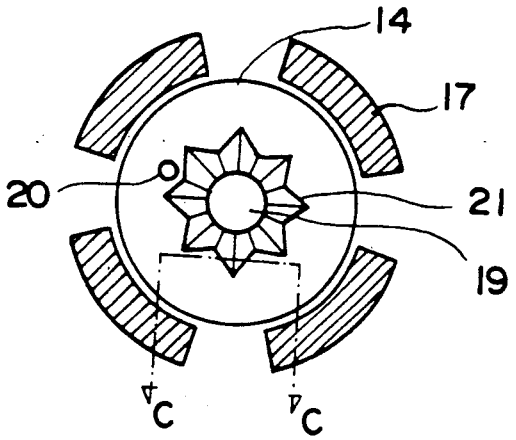
FIG. 4 is a sectional view taken along a line B—B in FIG. 2.
Figure 5:
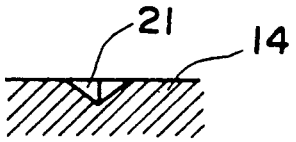
FIG. 5 is a sectional view taken along a line C—C in FIG. 4.
Figure 6A:
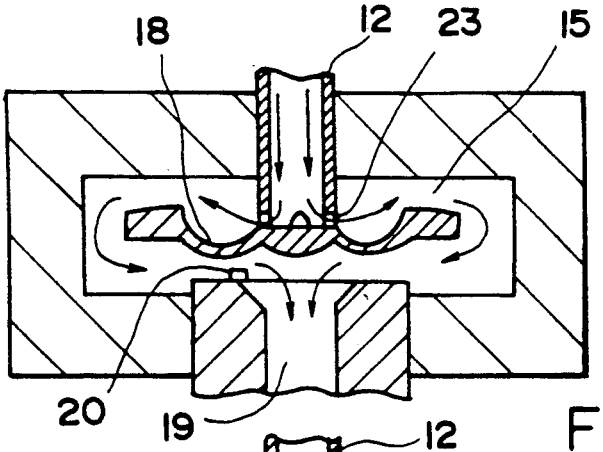
FIGS. 6(*a*) to 6(*d*) are views for explaining operations of the blowing feeling adder.
Figure 6B:
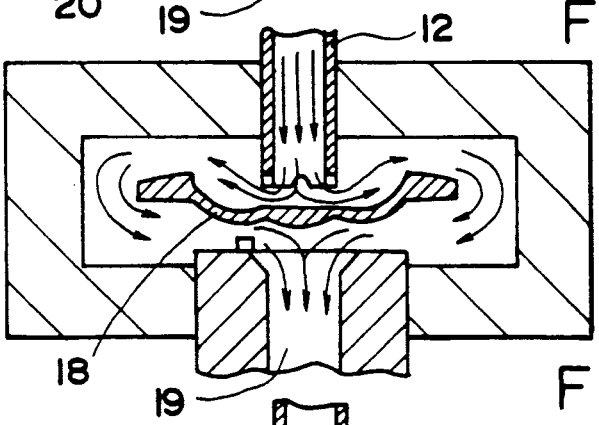
Figure 6C:
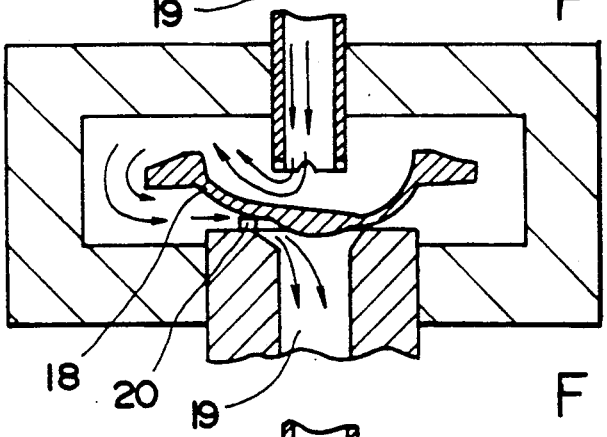
Figure 6D:
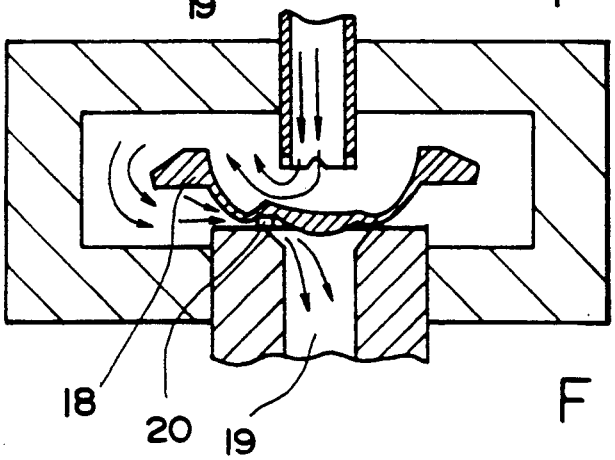

FIG. 2 is a sectional view showing the overall blowing feeling adder 8, FIG. 3 is a sectional view taken along a line A—A in FIG. 2, FIG. 4 is a sectional view taken along a line B—B in FIG. 2, and FIG. 5 is a sectional view taken along a line C—C in FIG. 4.

An entrance-side case 13 and an exit-side case 14 constitute a housing, and an air chamber 15 is formed therein. A breath inlet pipe (entrance pipe) 12 is mounted on or formed integrally with the entrance-side case 13, thus constituting an entrance of the air chamber 15. The breath inlet tube 7 is connected to the entrance pipe 12. Four notches 23 are formed in the end portion of the entrance pipe 23. These notches 23 allow air to pass therethrough when a breath pressure is low and a valve 18 (to be described later) closes the entrance, as will be described later.

A drain pipe (exit pipe) 19 is mounted on or formed integrally with the exit-side case 14, thus constituting an exit of the air chamber 15. The drain tube 9 is connected to the exit pipe 19. A groove 21 (FIGS. 4 and 5) is formed around the exit of the air chamber 15, and a projection 20 is formed at a given position around the exit. The projection 20 and the groove 21 assure communication of air when the valve 18 closes the exit.

Four stepped portions 16 are formed on the inner surface of the entrance-side case 13. Four stepped portions 17 are formed on the inner surface of the exit-side case 14 in a ring shape in correspondence with the stepped portions 16. A diaphragm valve 18 formed of, e.g., silicone rubber is clamped between these stepped portions 16 and 17. The diaphragm valve 18 is held by engaging its projecting portions 18*a* with the stepped portions 17 (FIG. 3). An interval a between the diaphragm valve 18 and the end portion of the entrance pipe 12 is preferably set to be −0.6 mm to −0.8 mm (when the valve is urged against the entrance pipe side). An interval b between the bottom surface of the diaphragm valve 18 and an exit surface is preferably set to be 1.6 mm to 2 mm.

The entrance and the exit in the air chamber 15 communicate with each other via a gap portion 22 (FIG. 3) between the stepped portions 16 and 17, arranged at four positions, for holding the diaphragm valve.

The operations of the blowing feeling adder with the above structure will be described below with reference to FIGS. 6(*a*) to 6(*d*).

In a range where a breath pressure P is low, as shown in FIG. 6(*a*), the diaphragm valve 18 closes the end portion of the entrance pipe 12 as the entrance of the air chamber 15 by its elastic force. In this case, air (breath) flows into the air chamber 15 via the notches 23 formed in the end portion of the entrance pipe 12, and is discharged from the exit pipe (drain pipe) 19. As a means for flowing air when the diaphragm valve 18 closes the entrance, a small hole may be formed in a portion of the diaphragm valve 18 opposing the entrance pipe 12 in place of or in addition to the notches 23.

When the breath pressure P is increased, as shown in FIG. 6(*b*), the diaphragm valve 18 is pressed by the breath pressure, and is separated from the entrance pipe 12, thus increasing the opening area of the entrance portion. Therefore, as the breath pressure P is increased, an increase amount of a flow rate Q is increased.

When the breath pressure P is further increased, the diaphragm valve 18 is further deformed, and is pressed against the exit side, thus closing the end portion of the exit pipe 19, as shown in FIG. 6(*c*). Therefore, the flow rate Q is decreased. In this case, the projection 20 and the groove 21 (FIGS. 2 and 4) formed around the exit portion serve as a spacer, and the exit is not completely closed, thus assuring a certain air flow path. Therefore, the flow rate Q can be prevented from being immediately and largely decreased. In addition, the projection 20 can prevent a flapping vibration phenomenon due to resonance of the valve when the diaphragm valve 18 closes the exit portion.

When the breath pressure P is further increased, the diaphragm valve 18 is more strongly pressed against the exit side. However, as shown in FIG. 6(*d*), a decrease in flow path due to the projection 20 is small, and hence, the flow rate Q is almost constant or is only slightly increased.

Figure 7:
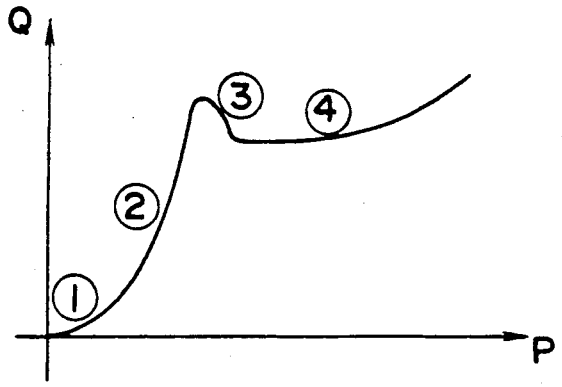
FIG. 7 is a graph showing flow rate characteristics of the blowing feeling adder.

The graph of FIG. 7 shows the relationship between the breath pressure P and the flow rate Q upon operation of the blowing feeling adder described above.

A section ① corresponds to a state in FIG. 6(*a*). Since the diaphragm valve 18 closes the entrance side, the flow rate Q is defined by only air flowing through the notches 23, and is small.

A section ② corresponds to a state in FIG. 6(*b*). Since the diaphragm valve 18 is opened by the breath pressure, and the opening area of the entrance portion is increased, the flow rate Q is immediately increased.

A section ③ corresponds to a state in FIG. 6(*c*). Since the diaphragm valve 18 is pressed against the exit portion, and decreases the opening area of the exit portion, the flow rate Q is decreased.

A section ④ corresponds to a state in FIG. 6(*d*). A change in air flow path formed by the projection 20 is small, and a change in flow rate is slow.

Figure 8:
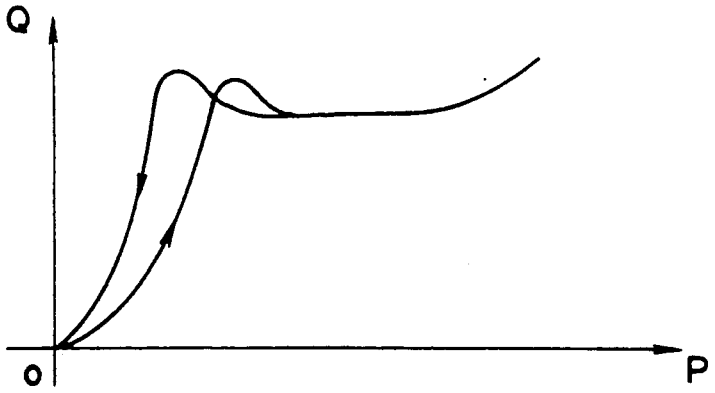
FIG. 8 is a graph showing hysteresis characteristics of the blowing feeling adder.
Figure 10:
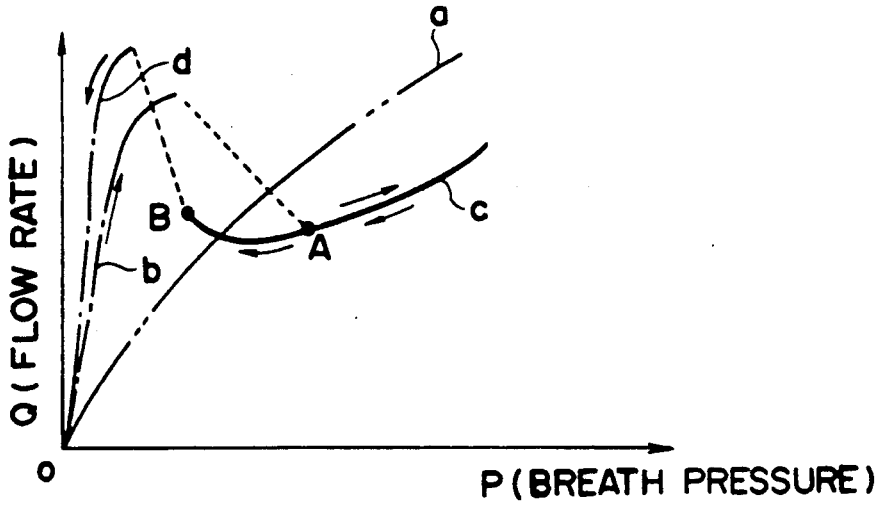
FIG. 10 is a graph for explaining characteristics of an alto saxophone as an acoustic wind instrument, and a conventional electronic wind instrument.

Such characteristics of the blowing feeling adder cause a hysteresis, as shown in FIG. 8, and are similar to those of an acoustic wind instrument (FIG. 10).

Figure 9:
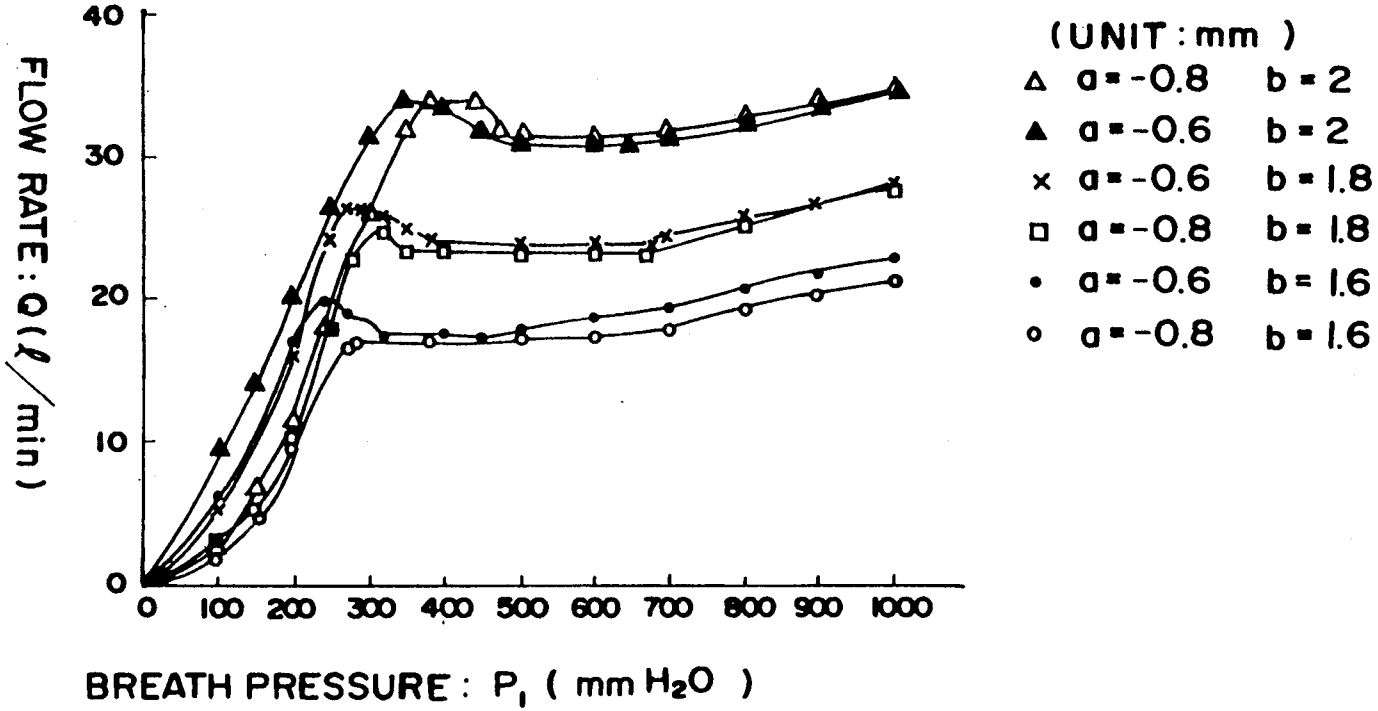
FIG. 9 is a graph showing test results of flow rate characteristics of the blowing feeling adder.

FIG. 9 is a graph of test results obtained in such a manner that the blowing feeling adder according to the present invention is prepared while changing the intervals a and b (FIG. 2), and a change in flow rate against a change in breath pressure is measured. The tests were conducted for six types of structures having different intervals a and b under a condition that a hole-less diaphragm having a hardness of 40° was used, and a projection having a height of 0.3 mm and a diameter of 1.0 mm was formed.

Figure 11:
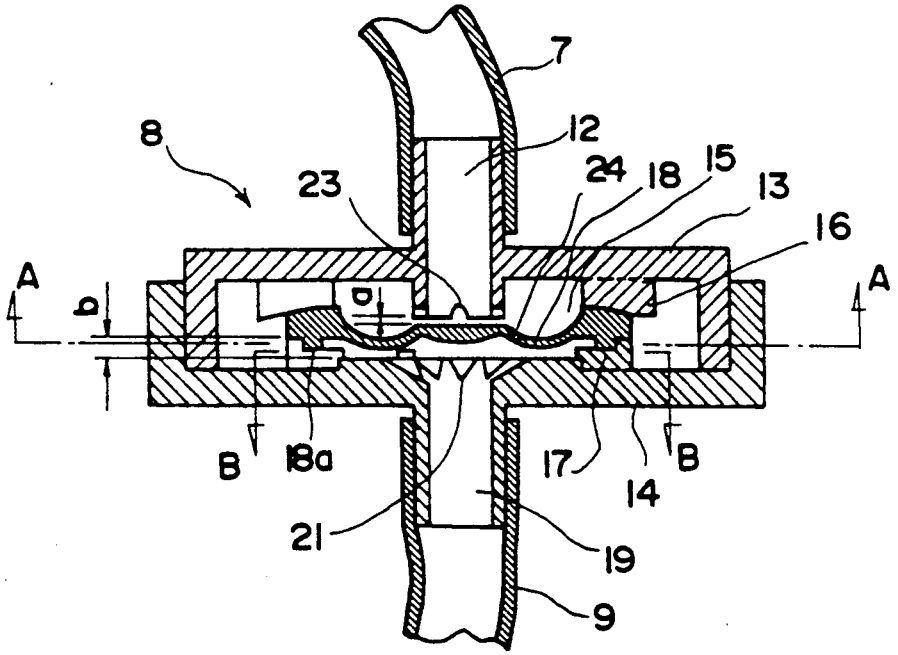
FIGS. 11 and 12 are views showing modifications of the blowing feeling adder shown in FIG. 2.
Figure 12:
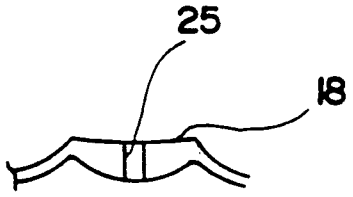

As can be seen from the graph, the flow rate characteristics against a change in breath pressure have a pattern approximate to those of an acoustic wind instrument. When the intervals a and b are appropriately changed, the flow rate in a tone generation pressure zone (zone where the flow rate becomes almost constant (FIG. 7(4)) can be changed. As a means for keeping the flow rate Q constant even when the breath pressure is changed, one or both of the projection 20 and the groove 21 serving as a spacer are arranged. As shown in FIG. 11, a small hole 24 may be formed in a portion of the valve corresponding to the exit portion (e.g., near the center of the movable portion of the valve), or as shown in FIG. 12, a small hole 25 may be formed at the central portion of the valve. In this manner, a zone for keeping the flow rate Q almost constant even when the breath pressure is changed can be assured.

As described above, according to the present invention, an air chamber is arranged along a blowing breath flow path, and an elastically deformable valve is arranged between an entrance and an exit of the air chamber. The valve is deformed by a breath pressure to change a flow rate. For this reason, when the breath pressure is very low, the flow rate and its change amount are decreased to allow easy control. When the breath pressure is low, a change amount of the flow rate is immediately increased, thus obtaining breath air relief feeling of an acoustic wind instrument. Furthermore, excess breath air relief feeling at the beginning of tone generation or in a tone generation region can be prevented, and flow rate characteristics similar to those of an acoustic wind instrument can be obtained in terms of feeling of a constant acoustic impedance and the like. Therefore, the same blowing feeling as the acoustic wind instrument can be obtained. In addition, a player does not feel with malaise from the acoustic wind instrument, thus improving blowing feeling.

What is claimed is:

1. An electronic wind instrument having a blowing feeling adder which comprises an air chamber having an entrance and an exit adjacent entrance and exit portions thereof respectively, an entrance pipe, coupled to the entrance of said air chamber, for introducing breath, an exit pipe, connected to the exit of said air chamber, for discharging the breath, and valve means being elastic and being interposed between the entrance and exit portions of said air chamber, said valve means being deformed according to a breath pressure at the entrance portion to change an opening area of the entrance and being pressed against the exit portion and decreasing an opening area of the exit when the breath pressure at the entrance portion of said air chamber exceeds a predetermined value.

2. An apparatus according to claim 1, wherein said adder further comprises spacer means for forming an air communication path between said valve means and the exit portion in at least a portion around the exit portion when said valve means is pressed toward the exit portion.

3. An apparatus according to claim 1, further comprising pressure detecting means for detecting the breath pressure and control means for controlling musical tone parameters on the basis of the breath pressure detected by said pressure detecting means.

4. An apparatus according to claim 3, wherein said detecting means is interposed between said entrance portion and said valve means.

5. An apparatus according to claim 2, further comprising pressure detecting means for detecting the breath pressure and control means for controlling musical tone parameters on the basis of the breath pressure detected by said pressure detecting means.

6. An apparatus according to claim 5, wherein said detecting means is interposed between said entrance portion and said valve means.

* * * * *